US007347588B2

(12) United States Patent
Weigert

(10) Patent No.: US 7,347,588 B2
(45) Date of Patent: Mar. 25, 2008

(54) FOCUSABLE SPOTLIGHT WITH ASYMMETRICAL LIGHT DISTRIBUTION

(75) Inventor: Dedo Weigert, München (DE)

(73) Assignee: Dedo Weigert Film GmbH, Munich (DE)

( * ) Notice: Subject to any disclaimer, the term of this patent is extended or adjusted under 35 U.S.C. 154(b) by 295 days.

(21) Appl. No.: 11/159,136

(22) Filed: Jun. 23, 2005

(65) Prior Publication Data

US 2005/0286249 A1 Dec. 29, 2005

(30) Foreign Application Priority Data

Jun. 23, 2004 (EP) ..... 04014665

(51) Int. Cl.
*F21V 17/02* (2006.01)

(52) U.S. Cl. ..... 362/282; 362/512; 362/322; 362/323

(58) Field of Classification Search ..... 362/280, 362/282, 322, 323, 512, 513, 308
See application file for complete search history.

(56) References Cited

U.S. PATENT DOCUMENTS

| | | | | |
|---|---|---|---|---|
| 2,210,554 | A * | 8/1940 | Palermo et al. | 362/322 |
| 2,282,167 | A | 5/1942 | Cullman | |
| 4,823,243 | A | 4/1989 | Weigert | |
| 5,915,829 | A | 6/1999 | Kalze et al. | |
| 6,004,007 | A | 12/1999 | Weigert | |
| 6,386,738 | B1 | 5/2002 | Staudacher | |
| 6,499,862 | B1 | 12/2002 | Weigert et al. | |
| 6,575,598 | B2 | 6/2003 | Weigert et al. | |

FOREIGN PATENT DOCUMENTS

| | | | |
|---|---|---|---|
| DE | 386071 | A | 12/1923 |
| EP | 0997684 | A2 | 5/2000 |
| FR | 2793001 | A1 | 11/2000 |

* cited by examiner

*Primary Examiner*—Stephen F. Husar
(74) *Attorney, Agent, or Firm*—Collard & Roe, P.C.

(57) ABSTRACT

A spotlight having a variable angle of radiation includes a light source and a converging lens. The converging lens is the front lens of the spotlight. The front lens is eccentrically arranged such that the principal optical axis of the front lens is not coincident with the principal optical axis of the spotlight. For example, the principal optical axis of the front lens is parallel to and spaced from the principal optical axis of the spotlight by a predetermined distance.

27 Claims, 5 Drawing Sheets

FOCUSABLE SPOTLIGHT WITH ASYMMETRICAL LIGHT DISTRIBUTION

BACKGROUND OF THE INVENTION

1. Field of the Invention

The invention is directed to a spotlight having a variable angle of radiation.

2. Description of the Related Art

Spotlights having variable angles of radiation are known, for example, from Applicant's prior patents such as U.S. Pat. No. 4,823,243, U.S. Pat. No. 6,004,007, U.S. Pat. No. 6,499,862, and U.S. Pat. No. 6,575,598. The object of the above-listed exemplary spotlights is in the technical design, wherein the emitted light intensity is as even as possible in any radiation angle position of the spotlight. With certain spotlight applications in the fields of film, television, photography, and museums, an evenly emitted light intensity is not advantageous. For example, with an application in a museum, one can normally assume that the spotlight is mounted higher than the object to be illuminated, whereby in an extreme case, the upper rim of the object is only half the distance away from the light source than the lower rim of the object. With an arrangement such as this, the light intensity on the upper rim of the object would be four times higher than on its distant end.

For the above-mentioned applications, there are conventional asymmetrical floodlights, wherein the light distribution is adjusted in the desired way by an asymmetrical construction of the reflector. Lights such as these can then also be utilized as foot ramps, for example, to illuminate backgrounds from below, and to likewise focus the asymmetrical reflector primarily on the upper end of the background. However, all of these conventional asymmetrical floodlights or foot ramps are always open-face lights without a front lens. They are also not focusable. This means that for each individual application, an asymmetrical floodlight that precisely fits the particular application must be used. Per the state of the art, if in a museum, for example, a large picture is replaced with a smaller one, a new asymmetrical floodlight, suitable to illuminate the smaller picture, must be mounted because it is not possible to focus the original floodlight, which was proper for the large picture, on the smaller surface.

Furthermore, unfavorable light distribution results have been adjusted, in many cases, with half scrims, according to the state of the art. These are wire screens having varying densities, which lower the light intensity by one-half or one aperture value (1 aperture value would be equal to half the intensity). Two of these half scrims can thereby also be placed in front of one another in order to balance the uneven illumination of the object to some degree. However, a truly perfect transition is thereby not accomplished, only a half-surface shading, that is, reduction, of the light intensity. The distant part of the object to be illuminated receives the full light intensity, whereas the parts of the object in closer proximity are subjected to an artificial reduction of light intensity. However, a continuous, even light intensity transition is not provided by the conventional half scrims.

SUMMARY OF THE INVENTION

It is the object of this invention to provide a spotlight with variable angles of radiation that systematically produces an asymmetrically radiating light intensity. The invention provides the solution with the spotlight having an eccentric arrangement of the front lens, whereby the front lens is oriented such that the principal optical axis of the front lens extends parallel to the principal optical axis of the spotlight, whereby the two optical main axes do not coincide.

It is the particular advantage of the spotlight of the present invention to combine the deliberate asymmetry in the light distribution with the focusability of the spotlight, which results in extraordinarily flexible application possibilities, even where one single spotlight is concerned. In the above-mentioned application in a museum and the replacement of the large picture with the small one, for example, a spotlight of the present invention does not need to be replaced during the exchange of these pictures. It merely needs to be focused on the new picture size, that is, its angle of radiation must be adjusted to the new picture size. The spotlight itself, however, can remain in its present spatial position and does not need to be replaced by a totally different spotlight.

Furthermore, the spotlight of the present invention provides a continuous, even light intensity transition. Thus, the total intensity of the available light can be fully utilized. Consequently, lower wattages can be used and the corresponding energy loss can be minimized. With all indoor applications, the accumulation of heat is thereby also reduced accordingly. This is of particular advantage considering that to this day, incandescent spotlights are still most frequently used for indoor applications and in studios, whereby the actual usable light is only about 10% of the expended energy.

Many studios still work almost exclusively with focused light and incandescent light. In a relatively small studio, the wattage used in a conventional setting is around 40 KW; with bigger studios and illuminations, it is several hundred kilowatts. Considering the additional energy expenditure required for air conditioning, a 40 KW incandescent light in a small studio, for example, requires approximately 200 KW for air conditioning. If spotlights of the present invention are used for the focused light, the energy expenditure for the focused light can be reduced by 50%, or even more. The energy savings multiply when the substantially lower energy expenditure for air conditioning due to the reduced illumination energy is added into the calculation.

The focusable light for application in film, television, and photography is generally characterized by a relatively small radiation surface and is normally positioned at some distance, which causes a rather distinct formation of shadows. This type of illumination is therefore generally backed up by large-surface lights. More and more frequently, surface lights with fluorescent tubes are employed in this field. However, these are most often designed such that they must be employed rather near the object to be illuminated. Because the camera is monocular, the camera lens can capture the recorded images only two-dimensionally, more or less. The depth effect of a room, which is natural when seeing with both eyes, is thereby lost. Therefore, even with newer trends towards softer and more diffused illumination arrangements, one will never be able to do without the background light, the contour light, the rim light, which more or less radiates towards the camera and has the function to give the objects a three-dimensional appearance—to stand out from a more plane picture image.

This method of illumination, whereby the intensity of the light that is directed towards the camera oftentimes is twice as much as that of the incident light from the camera side, will never be quite obsolete so that the focused light will still play an essential part, even with a very uniform, soft general illumination. Primarily in a case when the objects move while a picture is taken, the asymmetrical illumination with light that is focused by the focusable spotlights of the present invention offers substantial advantages, namely softer light intensity transitions and the reduced energy expenditure.

Most often, a focusable spotlight is positioned as a focused light at an angle of about 45 degrees radiating downward, whereby at the same time one can go by the assumption that the focused light is practically never employed directly from the camera axis but also at an angle, which laterally can frequently be 45 degrees, whereby greater angle variations can occur, which essentially can be compensated for by rotatably orienting the front lens. In addition, angle variations can be adjusted by the slideability of the eccentric front lens. With this embodiment of the spotlight of the present invention, it is possible to change the radial distance between the principal optical axis of the front lens and the principal optical axis of the spotlight.

The foregoing and other objects, features and advantages of the present invention will become more apparent from the following detailed description when taken in conjunction with the accompanying drawings.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

DETAILED DESCRIPTION OF THE PREFERRED EMBODIMENT

Reference will now be made in detail to the preferred embodiment of the present invention, examples of which are illustrated in the accompanying drawings. Wherever possible, the same reference numbers will be used throughout the drawings to refer to the same or like parts. Hereinafter, embodiments of the present invention will be explained with reference to FIGS. 1 through 5.

Figure 1:
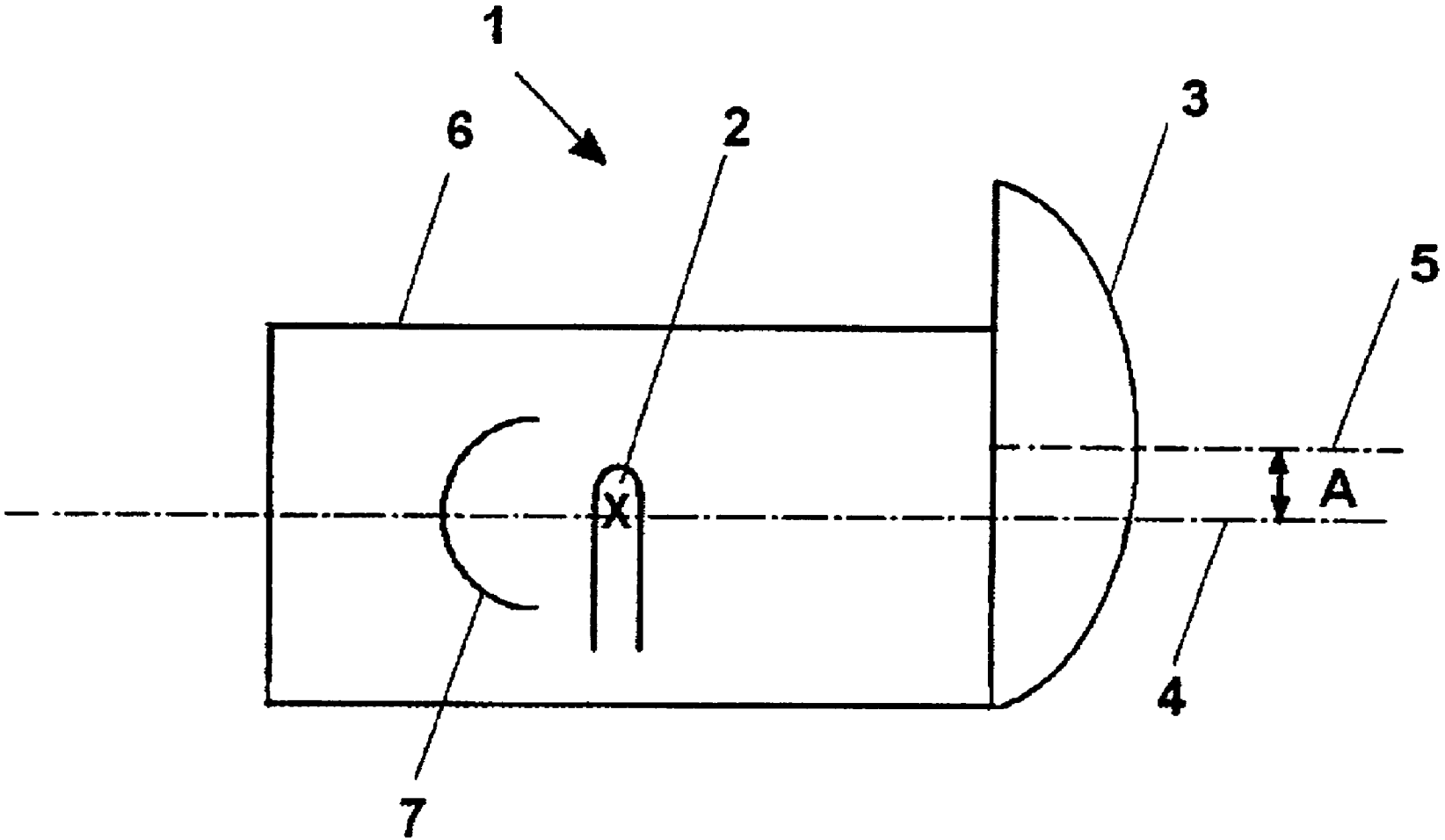
FIG. 1 is a diagrammatic side view of a first embodiment of a spotlight of the present invention.

A spotlight 1, which is illustrated in FIG. 1 as a first embodiment of the invention, comprises a housing 6. Inside the housing 6, a lamp 2 and a reflector 7 assigned to lamp 2, are arranged. A principal optical axis 4 of the spotlight 1 extends through the lamp 2 and the reflector 7 in the center of the cavity formed by the housing 6, as shown in FIG. 1.

The lamp 2 and the reflector 7 are movable inside the spotlight 1 so that the angle of radiation of the spotlight 1 can be altered. The ability to alter the angle of radiation is known from prior art and will not be described herein. For example, Applicant's prior patents U.S. Pat. No. 4,823,243, U.S. Pat. No. 6,004,007, U.S. Pat. No. 6,499,862, and U.S. Pat. No. 6,575,598 describe in detail the ability to vary the angle of radiation of a spotlight, and the entire contents of each of these patents are hereby incorporated by reference.

The embodiment of the spotlight of the present invention illustrated in FIG. 1 further includes a front lens 3. This front lens 3 is an eccentrically arranged converging lens, the principal axis of which is referenced in FIG. 1 with the numeral 5. The principal optical axis 5 of the front lens 3 extends parallel to the principal optical axis 4 of the spotlight 1 but does not coincide with it. The distance between the principal optical axis 4 of the spotlight 1 and the principal optical axis 5 of the front lens 3 is referenced in FIG. 1 with the letter A.

Figure 2:
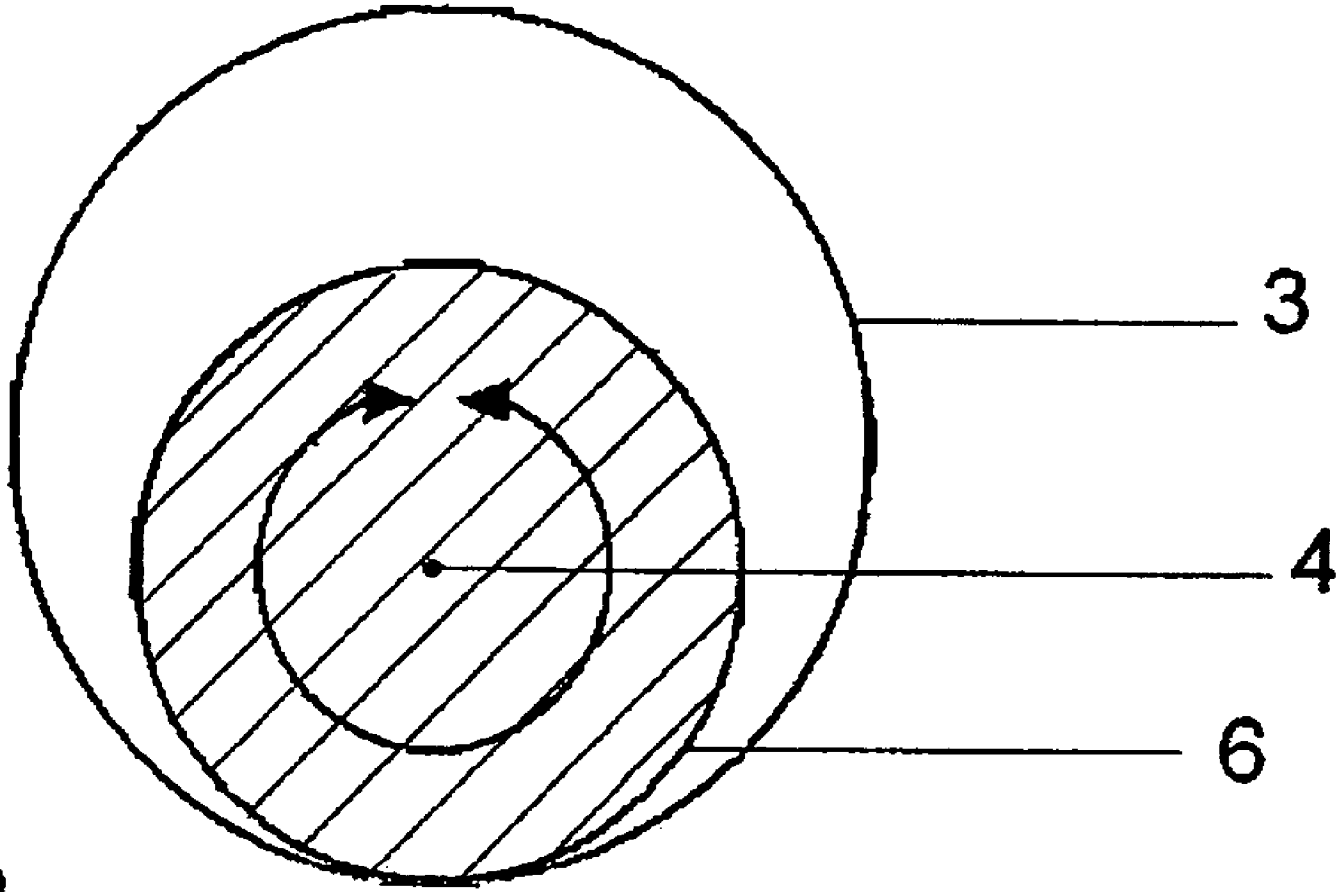
FIG. 2 is a front view of the spotlight in FIG. 1.

FIG. 2 illustrates a front view of the embodiment of the spotlight 1 of the invention in FIG. 1. For reasons of clarity, the principal optical axis 5 of the front lens 3 and its distance A to the principal optical axis 4 of the spotlight 1 are not illustrated in FIG. 2. As already illustrated in FIG. 1, it can also be clearly seen in FIG. 2 that in the first embodiment of the spotlight 1 of the present invention, the front lens 3 partially extends beyond the housing 6 of the spotlight 1.

The front lens 3 is positioned such that it can be rotated around the principal optical axis of the spotlight. In FIG. 2, this rotation is indicated by the arrows. The radial distance A from the principal optical axis 5 of the front lens 3 to the principal optical axis 4 of the spotlight 1, however, always remains constant in this embodiment of the spotlight of this invention. The front lens 3 of the embodiment in FIG. 1 is a symmetrical converging lens.

In other embodiments of the spotlight of the present invention, different types of converging lenses are used for front lenses. For example, in a particularly preferred embodiment of the spotlight of this invention, a converging lens is used for a front lens that is designed such that it appears to be cut out of a larger lens in a way that the cut-out usable part of the front lens is tangent to one side of the normal rim of the original larger lens. Imagine this type of front lens as a segment cut out of a larger lens in the described manner.

Figure 3:
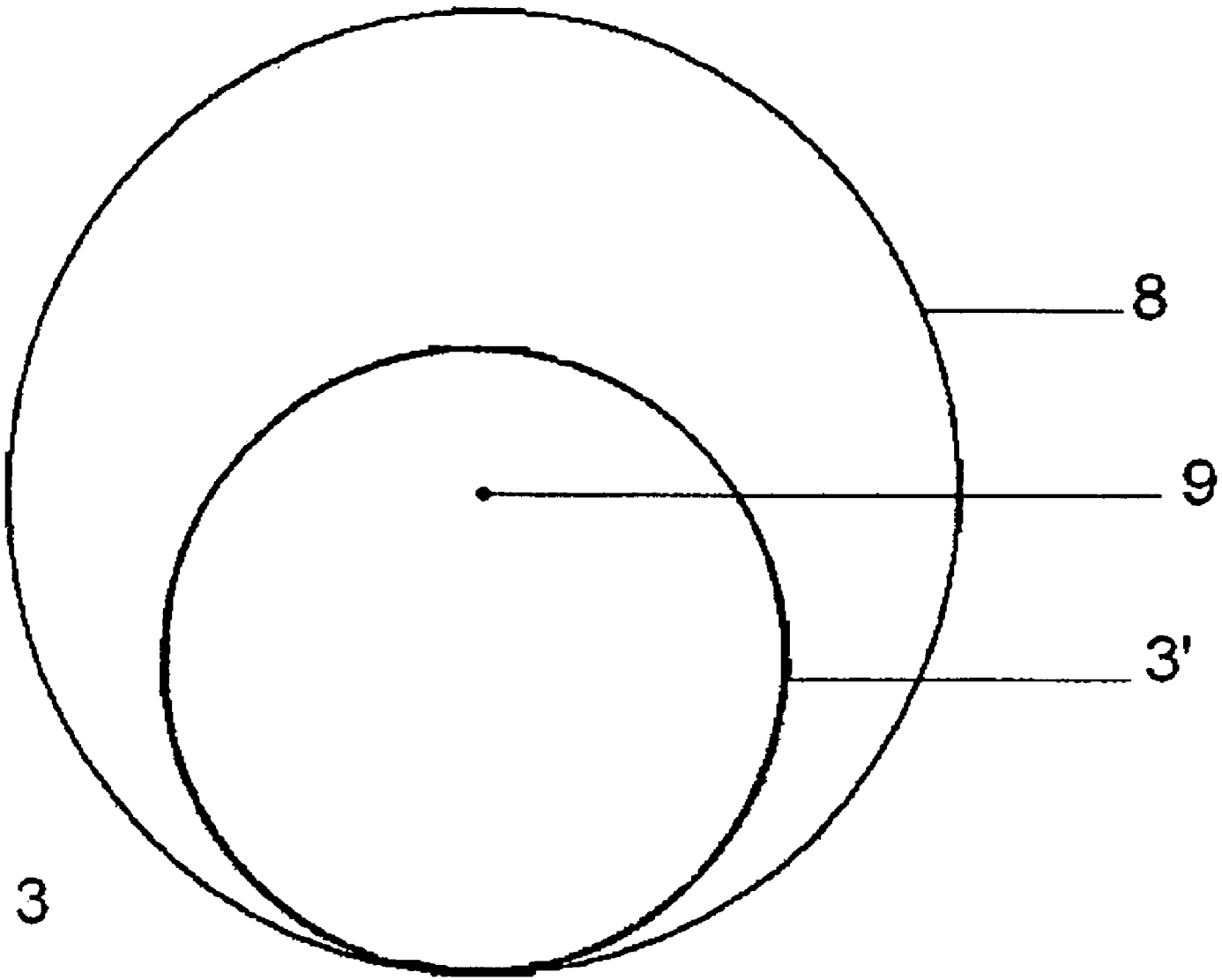
FIG. 3 is an illustration of the design of a front lens to be used in a second embodiment of the spotlight of the present invention.

For clarification purposes, this embodiment of a front lens 3' is illustrated in FIG. 3. The reference numeral 8 in FIG. 3 designates a common symmetrical converging lens as the basic lens, that is, as a "imaginary" basic lens. This basic lens 8 has in its center its principal optical axis 9. For the purpose of different embodiments of spotlights of the present invention, a converging lens 3' is used as a front lens for the spotlight, which is designed such that it appears to be cut out of the basic lens 8 in a way that the cut-out usable part of the front lens 3' (in FIG. 3 the front lens 3' as such) is tangent to one side of the normal rim of the basic lens 8. In this embodiment of the front lens 3', the principal optical axis 9 is no longer arranged central to the lens periphery. For the purpose of these embodiments of spotlights of the present invention, this has the advantage that contrary to the front lens 3 of the embodiments in FIGS. 1 and 2, the front lens 3' in FIG. 3 does not require a partial lateral extension beyond the spotlight housing 6.

Figure 4:
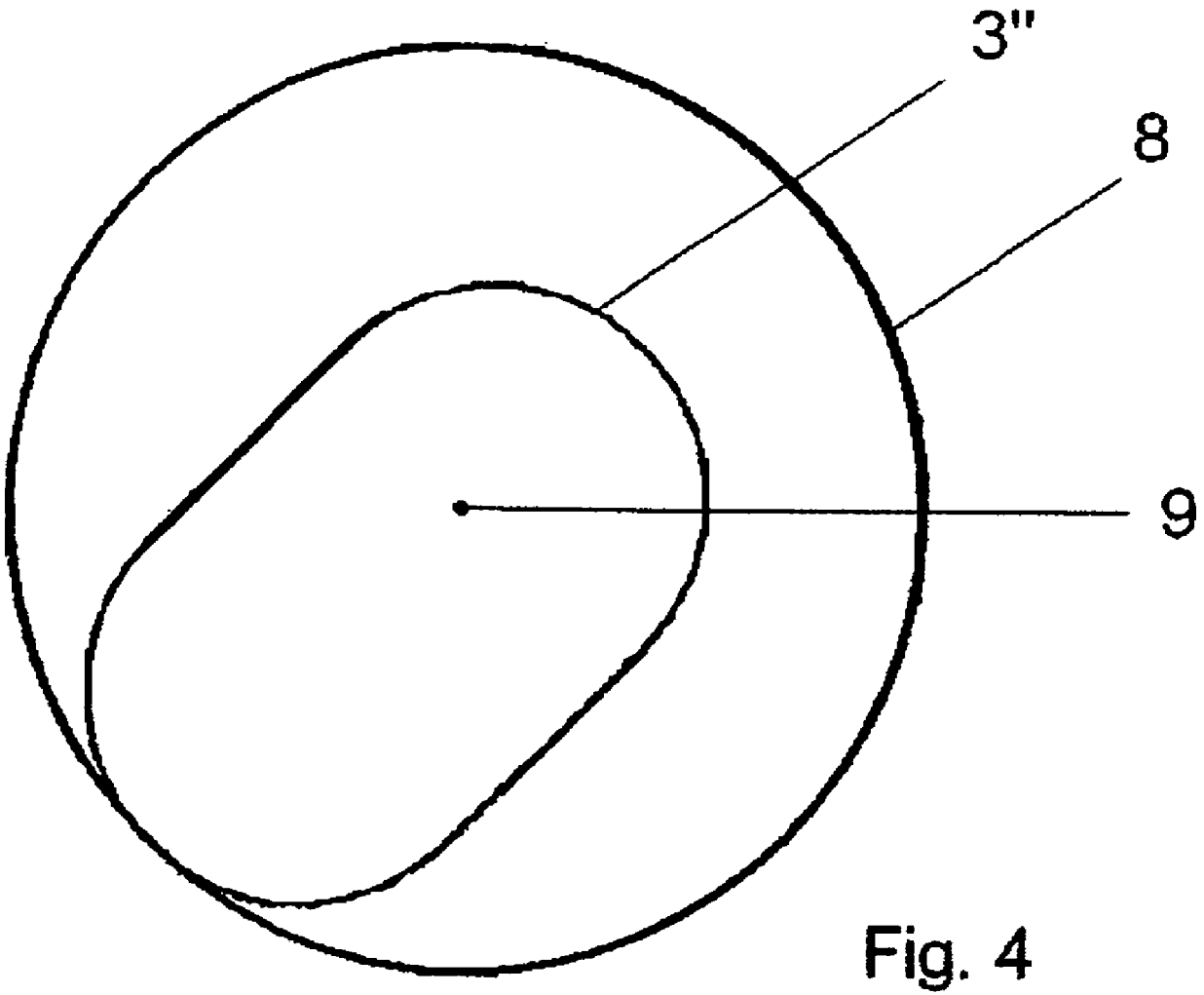
FIG. 4 is an illustration of the design of a front lens to be used in a third embodiment of the spotlight of the present invention.

The embodiments in FIGS. 1-3 were illustrated with front lenses 3, 3' having a circular perimeter. However, there are other embodiments of the spotlight of this invention, whereby the front lens does not have a circular perimeter. For example, the front lens may have an essentially oval-like perimeter. An embodiment for such a front lens is shown in FIG. 4 and has the reference numeral 3". This embodiment of a front lens 3" also goes back to the common symmetrical converging lens (basic lens) 8 with its principal optical axis 9, as known from FIG. 3. The front lens 3" of FIG. 4 is basically cut out of the basic lens, the common symmetrical converging lens 8, in a fashion similar to the front lens 3' in FIG. 3, except that the outer shape is somewhat different.

Figure 5:
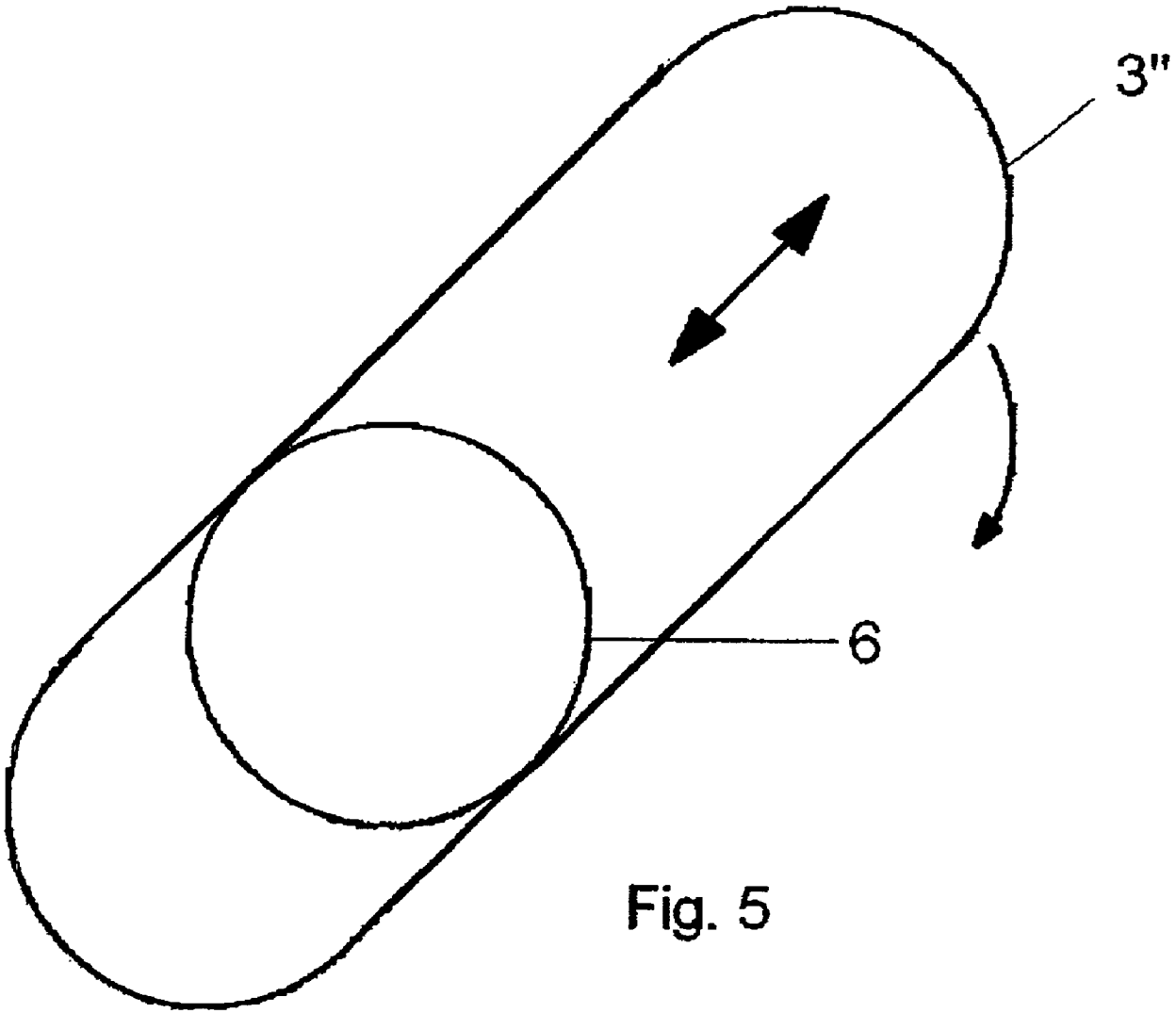
FIG. 5 is a front view of the third embodiment of the spotlight of the present invention.

Lastly, FIG. 5 shows how the front lens 3" of FIG. 4 is mounted onto the spotlight housing 6, thus leading to a further embodiment of the spotlight of the present invention.

Although the principal optical axis of the spotlight is not actually illustrated in FIG. 5, it also extends in this embodiment, as in FIGS. 1 and 2, exactly in the center of the cavity formed by the spotlight housing 6. The front lens 3" of FIGS. 4 and 5 is rotatably positioned around the principal optical axis of the spotlight. This is indicated by the curved arrow in FIG. 5. Moreover, the front lens 3" can be moved to and fro in a radial direction with respect to the principal optical axis of the spotlight. This moveability is indicated by the straight double arrow in FIG. 5. In this embodiment of the spotlight of the present invention, the radial distance of the principal optical axis of the front lens 3" to the principal optical axis of the spotlight can also be changed.

Although only a one-lens system has been described in detail as an embodiment of the spotlight of this invention, the invention is not limited to one-lens focusable spotlights. Rather, it also includes two-lens or overall multi-lens focusable spotlights, whereby one lens or a plurality of lenses are arranged between the front lens and the lamp.

The invention is not limited to spotlights of a certain performance class. For example, spotlights of the present invention can be both miniature spotlights with an output of several watts, and high-performance spotlights with an output of several kilowatts or more.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A focus able spotlight having a variable angle of radiation, comprising:

a light source arranged inside the spotlight; and a converging lens, the converging lens being the front lens of the spotlight, wherein the front lens is eccentrically arranged, wherein the front lens has a shape that appears to be cut out of a larger lens in a way that the cut-out usable part of the front lens is tangent to one side of a normal rim of the original larger lens.

2. The focusable spotlight according to claim 1, wherein the front lens is rotatably positioned around a principal optical axis of the spotlight.

3. The focusable spotlight according to claim 1, wherein the front lens is slideable in a direction that is radial to a principal optical axis of the spotlight.

4. The focusable spotlight according to claim 2, wherein the front lens is slideable in a direction that is radial to the principal optical axis of the spotlight.

5. A focusable spotlight having a variable angle of radiation, comprising:

a housing;

a light source located within the housing, the light source emitting light within the housing to define a principal optical axis of the spotlight; and a converging lens located at a front end of the housing, the converging lens having a principal optical axis which is spaced from the principal optical axis of the spotlight, wherein the converging lens is asymmetric about the principal optical axis of the converging lens.

6. The focusable spotlight according to claim 5, wherein the principal optical axis of the converging lens is parallel to the principal optical axis of the spotlight.

7. The focusable spotlight according to claim 5, wherein the converging lens is rotatable around the principal optical axis of the spotlight.

8. The focusable spotlight according to claim 5, wherein the converging lens is slideable in a direction perpendicular to the principal optical axis of the spotlight.

9. The focusable spotlight according to claim 5, wherein a perimeter of the converging lens is non-circular.

10. The focusable spotlight according to claim 5, wherein a perimeter of the converging lens is oval-shaped.

11. The focusable spotlight according to claim 5, wherein a portion of the converging lens extends beyond an edge of the housing in a direction perpendicular to the principal optical axis of the spotlight.

12. A focusable spotlight having a variable angle of radiation, comprising:

a housing;

a light source located within the housing, the light source emitting light within the housing to define a principal optical axis of the spotlight; and a converging lens located at a front end of the housing, the converging lens having a principal optical axis which is spaced from the principal optical axis of the spotlight, wherein a perimeter of the converging lens is non-circular.

13. The focusable spotlight according to claim 12, wherein the principal optical axis of the converging lens is parallel to the principal optical axis of the spotlight.

14. The focusable spotlight according to claim 12, wherein the converging lens is rotatable around the principal optical axis of the spotlight.

15. The focusable spotlight according to claim 12, wherein the converging lens is slideable in a direction perpendicular to the principal optical axis of the spotlight.

16. The focusable spotlight according to claim 12, wherein the converging lens is symmetric about the principal optical axis of the converging lens.

17. The focusable spotlight according to claim 12, wherein the converging lens is asymmetric about the principal optical axis of the converging lens.

18. The focusable spotlight according to claim 12, wherein a perimeter of the converging lens is oval-shaped.

19. The focusable spotlight according to claim 12, wherein a portion of the converging lens extends beyond an edge of the housing in a direction perpendicular to the principal optical axis of the spotlight.

20. A focusable spotlight having a variable angle of radiation, comprising:

a housing;

a light source located within the housing, the light source emitting light within the housing to define a principal optical axis of the spotlight; and a converging lens located at a front end of the housing, the converging lens having a principal optical axis which is spaced from the principal optical axis of the spotlight, wherein a perimeter of the converging lens is oval-shaped.

21. The focusable spotlight according to claim 20, wherein the principal optical axis of the converging lens is parallel to the principal optical axis of the spotlight.

22. The focusable spotlight according to claim 20, wherein the converging lens is rotatable around the principal optical axis of the spotlight.

23. The focusable spotlight according to claim 20, wherein the converging lens is slideable in a direction perpendicular to the principal optical axis of the spotlight.

24. The focusable spotlight according to claim 20, wherein the converging lens is symmetric about the principal optical axis of the converging lens.

25. The focusable spotlight according to claim 20, wherein the converging lens is asymmetric about the principal optical axis of the converging lens.

26. The focusable spotlight according to claim 20, wherein a perimeter of the converging lens is non-circular.

27. The focusable spotlight according to claim 20, wherein a portion of the converging lens extends beyond an edge of the housing in a direction perpendicular to the principal optical axis of the spotlight.

* * * * *

UNITED STATES PATENT AND TRADEMARK OFFICE

CERTIFICATE OF CORRECTION

PATENT NO. : 7,347,588 B2
APPLICATION NO. : 11/159136
DATED : March 25, 2008
INVENTOR(S) : Weigert It is certified that error appears in the above-identified patent and that said Letters Patent is hereby corrected as shown below:

Column 5, line 33, (Line 1 of Claim 1), please change "focus able" to correctly read:

--focusable--.

Signed and Sealed this

First Day of July, 2008

JON W. DUDAS
*Director of the United States Patent and Trademark Office*